US010060586B1

(12) United States Patent
Chen et al.

(10) Patent No.: US 10,060,586 B1
(45) **Date of Patent: *Aug. 28, 2018**

(54) FLAMELESS CANDLE WITH ELECTROMAGNETIC SWAY MODULE

(71) Applicant: ZHU HAI FU YUN LIGHTING INDUSTRIAL CO., LTD., Zhuhai, Guangdong Province (CN)

(72) Inventors: Su-Hua Chen, New Taipei (TW); Chi-Shih Lai, New Taipei (TW)

(73) Assignee: Zhu Hai Fu Yun Lighting Industrial Co., Ltd., Zhuhai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/807,108

(22) Filed: Nov. 8, 2017

(51) Int. Cl.
*F21S 10/04* (2006.01)
*F21S 6/00* (2006.01)

(52) U.S. Cl.
CPC ..... *F21S 10/046* (2013.01); *F21S 6/001* (2013.01)

(58) Field of Classification Search
CPC ..... F21S 10/04; F21S 10/046; F21S 10/026
See application file for complete search history.

(56) References Cited

U.S. PATENT DOCUMENTS 8,733,986 B2 * 5/2014 Hau ..... F21S 10/046 362/161
2006/0146544 A1 * 7/2006 Leung ..... F21S 6/001 362/392

* cited by examiner

*Primary Examiner* — Robert May
(74) *Attorney, Agent, or Firm* — Muncy, Geissler, Olds & Lowe, P.C.

(57) ABSTRACT

An electric flameless candle is disclosed; the electric flameless candle includes a case, a translucent shell positioning unit, a translucent shell, a light emitting unit, a connecting unit, an electromagnetic sway module, a circuit board and a power unit. The case includes an opening. The translucent shell positioning unit is located at the opening. The translucent shell is located on the translucent shell positioning unit and includes a translucent shell base. The light emitting unit is located on the translucent shell base and in the translucent case. The connecting unit is connected to the translucent shell base. The electromagnetic sway module is located in the case. The electromagnetic sway module includes a metal bar, a metal coil and a metal core. The metal coil is connected to the fixing stand and located under the metal bar. The metal core is located in the metal coil.

11 Claims, 8 Drawing Sheets

FLAMELESS CANDLE WITH ELECTROMAGNETIC SWAY MODULE

BACKGROUND OF THE INVENTION

1. Field of the Invention

The present invention relates to an electric flameless candle; more particularly, the present invention relates to an electric flameless candle which provides the effect of a swaying candle flame without risk of fire or air pollution.

2. Description of the Related Art

In daily life, people sometimes may light a traditional candle to increase the comfort and relaxed atmosphere of a living space; in addition, in a church or a temple, people may also light a candle for praying. The flame of a traditional candle will sway with the airflow, and the light of the swaying candle flame makes the atmosphere more romantic and relaxed.

However, the traditional candle has some limits; for example, the traditional candle should not be used in a flammable environment, and when a traditional candle is used, it should not be left unattended due to the risk of fire. Furthermore, the combustion of a traditional candle generates carbon dioxide, which can affect the air quality.

Therefore, there is a need to provide an electric candle without a flame which can provide the lighting effect of a swaying candle flame without risk of fire or air pollution.

SUMMARY OF THE INVENTION

It is an object of the present invention to provide an electric flameless candle which provides the lighting effect of a swaying candle flame without risk of fire or air pollution.

To achieve the abovementioned objects, the electric flameless candle of the present invention includes a case, a translucent shell positioning unit, a translucent shell, a light emitting unit, a connecting unit, an electromagnetic sway module, a circuit board and a power unit. The case includes an opening. The translucent shell positioning unit is located at the opening. The translucent shell is located on the translucent shell positioning unit, wherein the translucent shell includes a translucent shell base. The light emitting unit is located on the translucent shell base, and located in the translucent case. The connecting unit is connected to the translucent shell base. The electromagnetic sway module is located in the case. The electromagnetic sway module includes a metal bar, a metal coil and a metal core. The metal bar is connected to the connecting unit. When the metal bar sways, the metal bar causes the translucent shell to sway. The metal coil is located under the metal bar. The metal core is located in the metal coil. The circuit board is located in the case. The power unit is electrically connected to the light emitting unit, the electromagnetic sway module and the circuit board. When the circuit board provides a pulse current to the metal coil, the energizing metal coil lets the metal core become magnetic, and a magnetic field is formed between the metal bar and the metal core; the magnetic field causes the metal bar to sway above the metal core, and the swaying of the metal bar causes the translucent shell to sway via the connecting unit.

According to one embodiment of the present invention, the circuit board provides the pulse current to the metal coil irregularly.

According to one embodiment of the present invention, the translucent shell base further includes at least one base connecting unit, the connecting unit further includes at least one correspondingly connecting unit; the at least one correspondingly connecting unit is connected to the at least one base connecting unit.

According to one embodiment of the present invention, the translucent shell positioning unit includes a positioning groove and a hole. The positioning groove is connected to the hole, the translucent shell base is located on the positioning groove, and the at least one base connecting unit passes through the hole to connect to the at least one correspondingly connecting unit.

According to one embodiment of the present invention, the electric flameless candle further includes a circuit board fastening unit, and the circuit board fastening unit is located in the case and fastened to the circuit board.

According to one embodiment of the present invention, the light emitting unit further includes a tip, and the tip supports the translucent shell.

According to one embodiment of the present invention, an amount of the at least one base connecting unit is two, and an amount of the at least one correspondingly connecting unit is two.

According to one embodiment of the present invention, the light emitting unit is a light emitting diode.

According to one embodiment of the present invention, the metal bar is an iron bar.

According to one embodiment of the present invention, the metal core is an iron core.

According to one embodiment of the present invention, the metal coil is a copper coil.

BRIEF DESCRIPTION OF THE DRAWINGS

These and other objects and advantages of the present invention will become apparent from the following descriptions of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
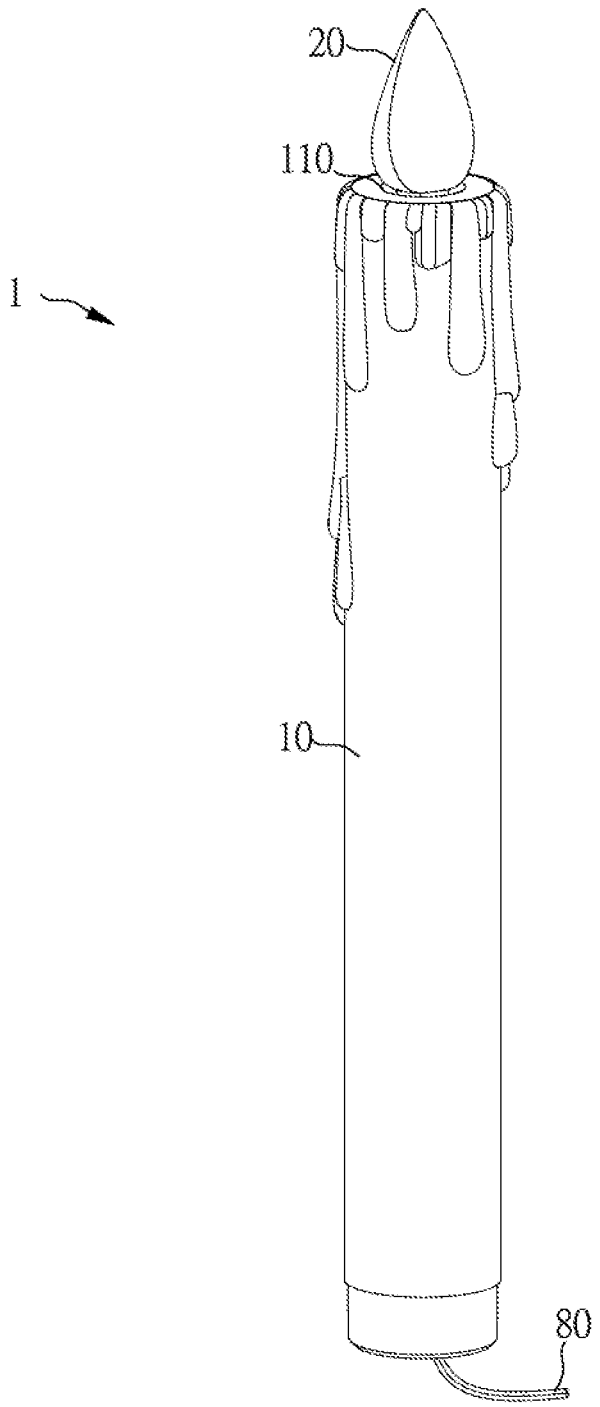
FIG. 1 illustrates a schematic drawing of the electric flameless candle in the first embodiment of the present invention.
Figure 2:
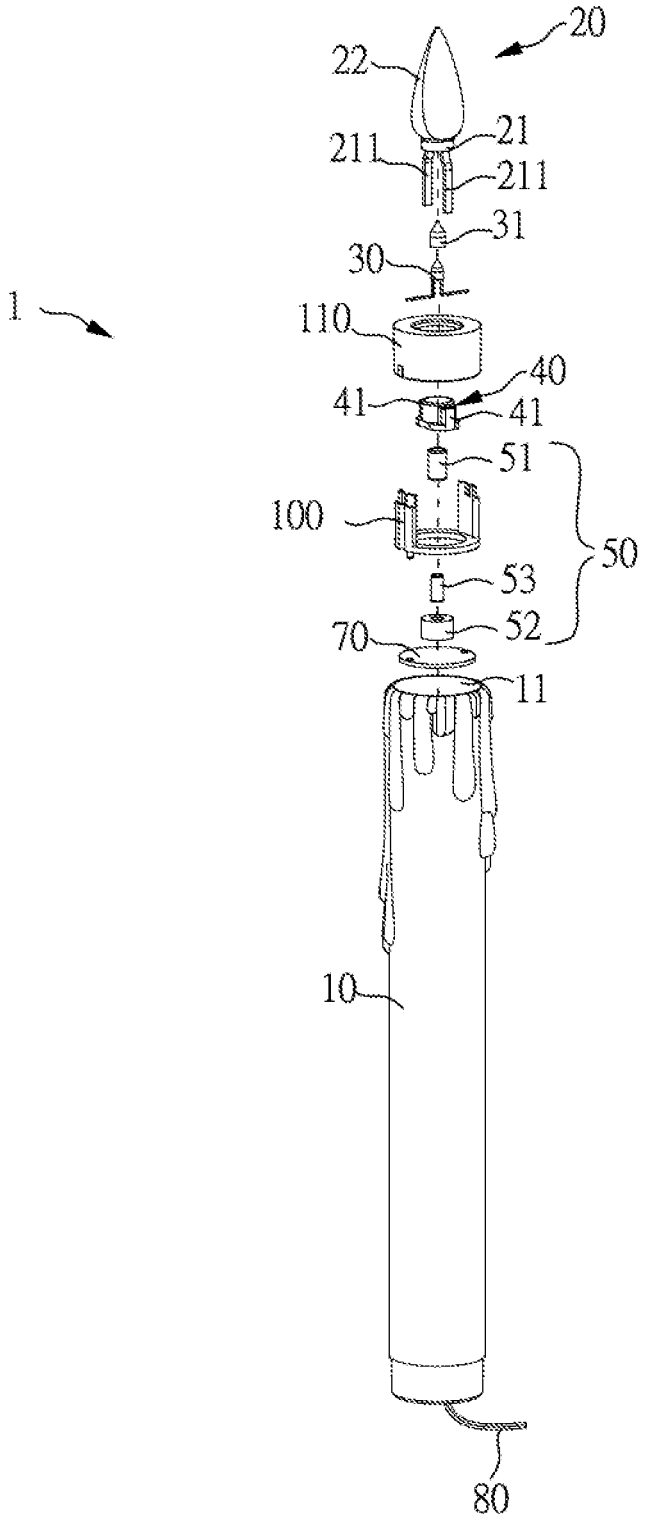
FIG. 2 illustrates an exploding perspective view of the electric flameless candle in the first embodiment of the present invention.
Figure 3:
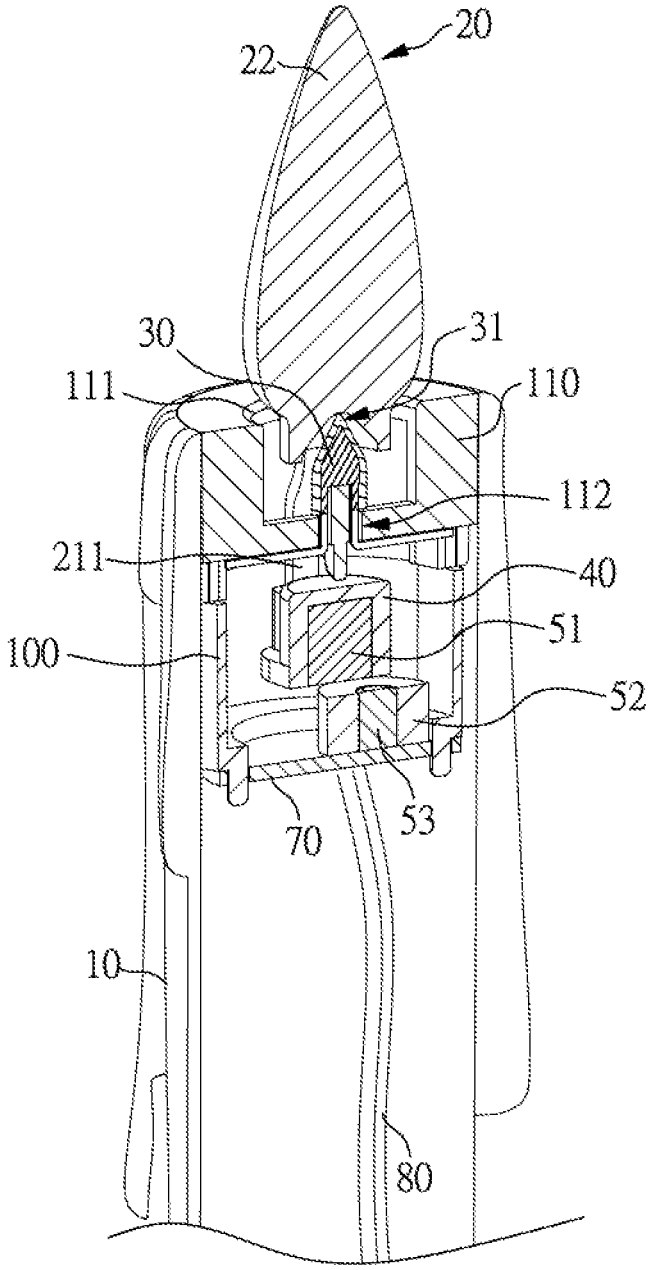
FIG. 3 illustrates a sectional view of the electric flameless candle in the first embodiment of the present invention.
Figure 4:
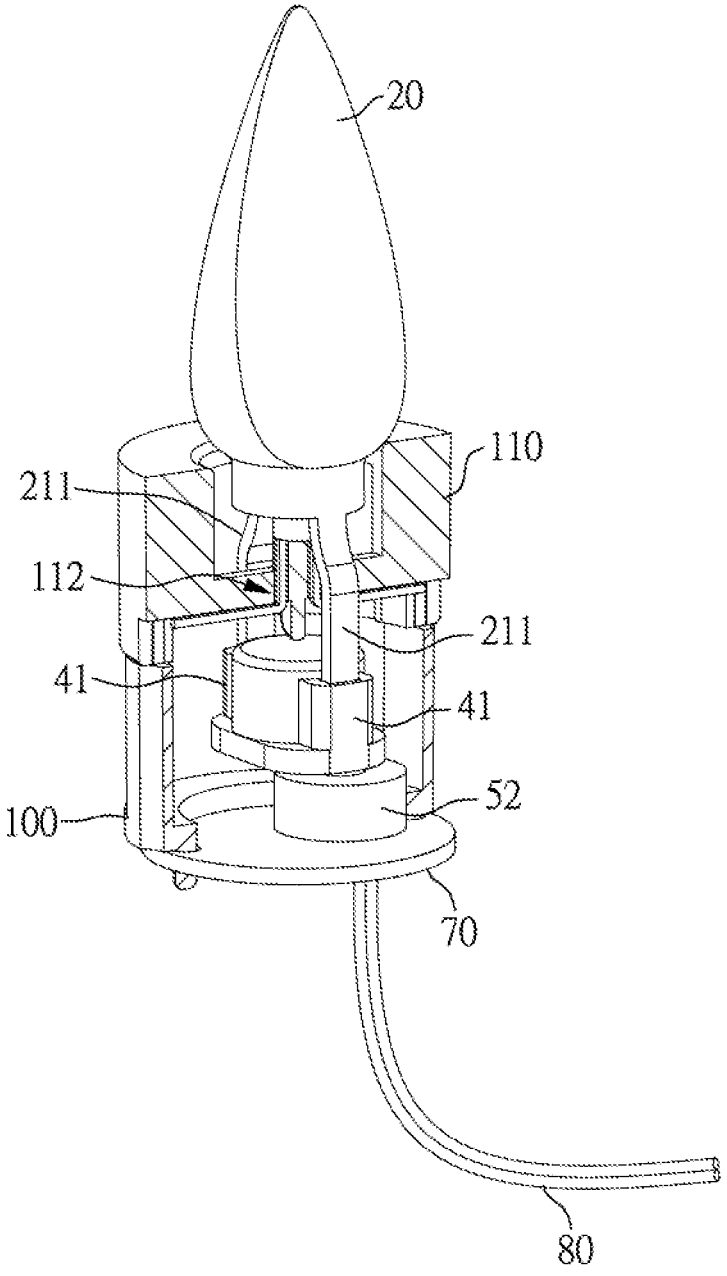
FIG. 4 illustrates a partial cross-sectional drawing of the electric flameless candle in the first embodiment of the present invention.
Figure 5:
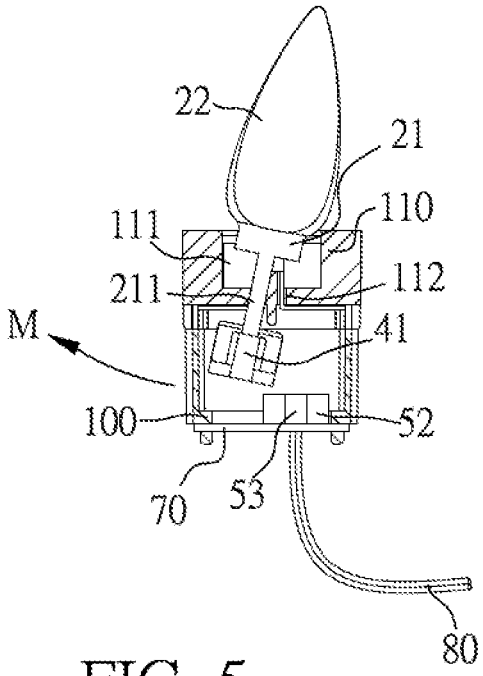
FIG. 5 illustrates a schematic drawing of the metal bar of the electric flameless candle which sways along the sway direction in the first embodiment of the present invention.
Figure 6:
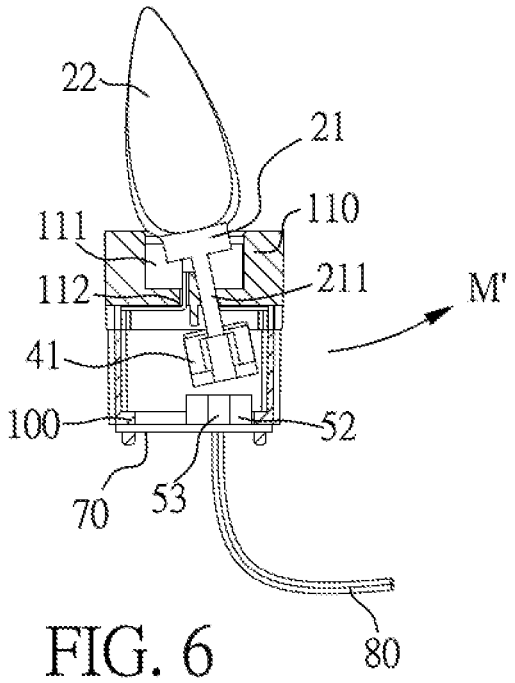
FIG. 6 illustrates a schematic drawing of the metal bar of the electric flameless candle which sways along another sway direction in the first embodiment of the present invention.
Figure 7:
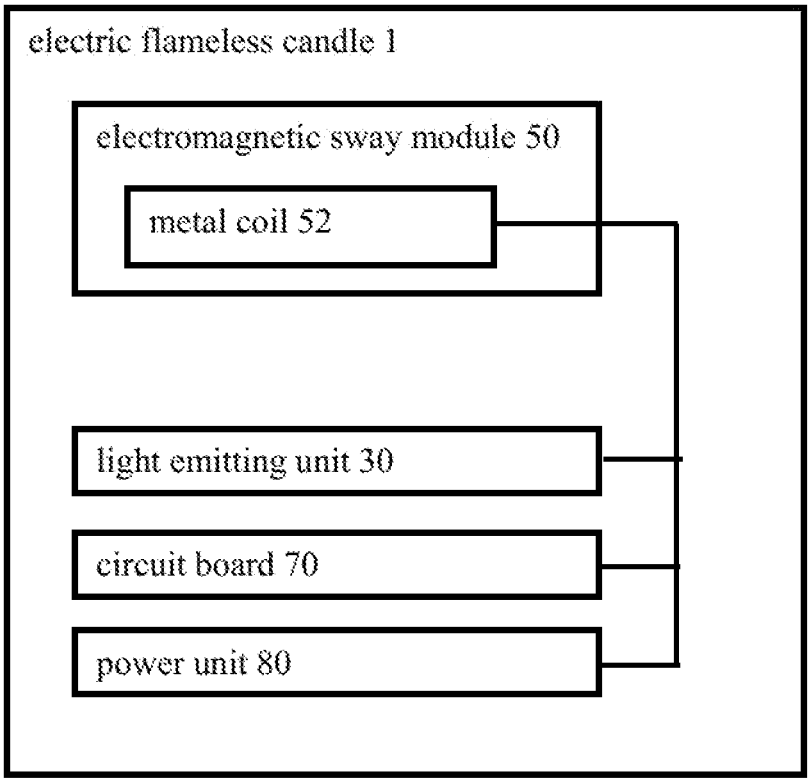
FIG. 7 illustrates a system structure drawing of the electric flameless candle in the first embodiment of the present invention.
Figure 8:
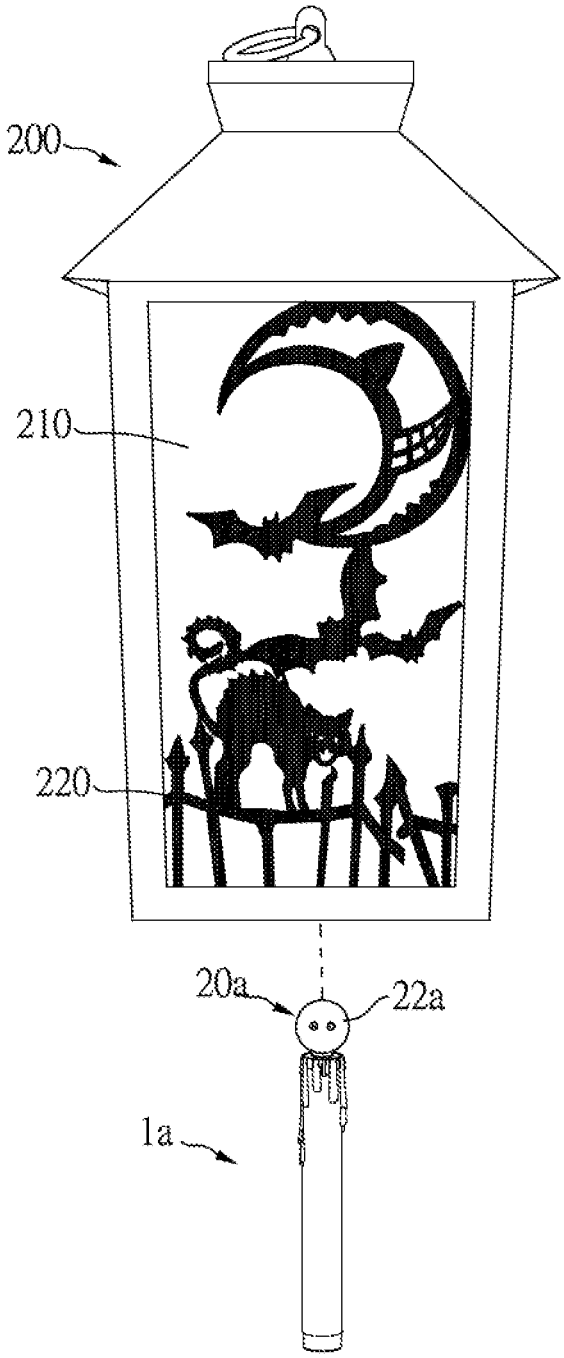
FIG. 8 illustrates a partial drawing of the electric flameless candle and the lampshade in the first embodiment of the present invention.
Figure 9:
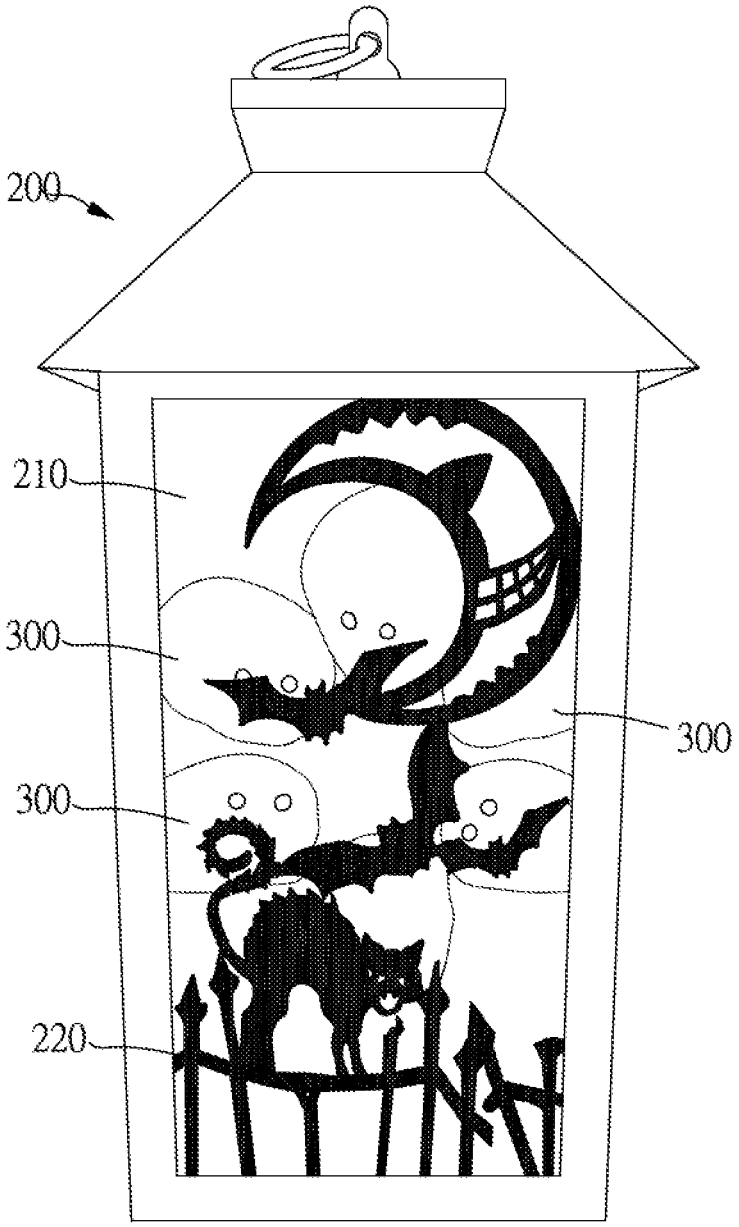
FIG. 9 illustrates an using schematic drawing of the electric flameless candle and the lampshade in the first embodiment of the present invention.

Please refer to FIG. 1 to FIG. 9 regarding the electric flameless candle of the present invention. FIG. 1 illustrates a schematic drawing of the electric flameless candle in the first embodiment of the present invention. FIG. 2 illustrates an exploding perspective view of the electric flameless candle in the first embodiment of the present invention. FIG. 3 illustrates a sectional view of the electric flameless candle in the first embodiment of the present invention. FIG. 4 illustrates a partial cross-sectional drawing of the electric flameless candle in the first embodiment of the present invention. FIG. 5 illustrates a schematic drawing of the metal bar of the electric flameless candle which sways along the sway direction in the first embodiment of the present invention. FIG. 6 illustrates a schematic drawing of the metal bar of the electric flameless candle which sways along another sway direction in the first embodiment of the present invention. FIG. 7 illustrates a system structure drawing of the electric flameless candle in the first embodiment of the present invention. FIG. 8 illustrates a partial drawing of the electric flameless candle and the lampshade in the first embodiment of the present invention. FIG. 9 illustrates an using schematic drawing of the electric flameless candle and the lampshade in the first embodiment of the present invention.

As shown in FIG. 1 to FIG. 2, the electric flameless candle 1 of the first embodiment of the present invention is an electric candle which uses light to imitate the effect of a swaying flame; the electric flameless candle 1 has no flame, so the electric flameless candle 1 poses no risk of fire or air pollution. The electric flameless candle 1 includes a case 10, a translucent shell 20, a light emitting unit 30, a connecting unit 40, an electromagnetic sway module 50, a circuit board 70, a power unit 80, a circuit board fastening unit 100 and a translucent shell positioning unit 110.

As shown in FIG. 1 to FIG. 3, in the first embodiment of the present invention, the case 10 is a candle-shaped tube for containing the electronic units of the electric flameless candle 1. The case 10 includes an opening 11. The opening 11 is located at the top of the candle-shaped tube of the case 10 for containing the translucent shell 20 and the translucent shell positioning unit 110. The translucent shell positioning unit 110 is located at the opening 11. The translucent shell positioning unit 110 includes a positioning groove 111 and a hole 112. The bottom of the positioning groove 111 is connected to the hole 112. The positioning groove 111 is used for locating the translucent shell 20.

As shown in FIG. 2 to FIG. 6, in the first embodiment of the present invention, the translucent shell 20 is used for imitating the shape and the lighting effect of a candle flame. The translucent shell 20 includes a translucent shell base 21 and a translucent case 22. The translucent shell base 21 includes two base connecting units 211 which are shaped as two columns. The translucent shell base 21 of the translucent shell 20 is located on the positioning groove 111 of the translucent shell positioning unit 110, and the two base connecting units 211 pass through the hole 112. The translucent case 22 is a shaped as a candle flame and made of translucent and refractive material to imitate the shape and the lighting effect of a candle flame. However, the translucent case 22 can also be shaped as other shape, such as a spherical shell with two spots, and the amount of the base connecting units 211 is not limited to two, the amount can be changed according to the design requirement.

As shown in FIG. 2 to FIG. 4 and FIG. 7, in the first embodiment of the present invention, the light emitting unit 30 is a light emitting diode for emitting light. The light emitting unit 30 is located on the translucent shell base 21, and located in the translucent case 22. When the light emitting unit 30 emits light, the translucent case 22 can present the shape and the lighting effect of a candle flame via the candle flame shape and the refractive effect of the translucent case 22. The light emitting unit 30 includes a tip 31. The tip 31 is a removable transparent cap, or the tip 31 can also be designed to be integrated with the whole structure of the emitting unit 30. The tip 31 touched and supports the bottom of the translucent shell 20; whereby, when the electromagnetic sway module 50 sways, the tip 31 can let the translucent case 22 of the translucent shell 20 be stable via the supporting, to prevent the translucent case 22 to be affected by the swaying of the electromagnetic sway module 50 and to be gradually loose.

In the first embodiment of the present invention, the connecting unit 40 is connected to the electromagnetic sway module 50 and the translucent shell 20. The connecting unit 40 includes two correspondingly connecting units 41. The two correspondingly connecting units 41 are two slots; the two column-shaped base connecting units 211 pass through the hole 112 to respectively connect to the two slots of the correspondingly connecting units 41; whereby, when the electromagnetic sway module 50 sways, the electromagnetic sway module 50 causes the translucent shell 20 to sway via the connection of the connecting unit 40. However, the amount of the correspondingly connecting unit 41 is not limited to that design; the amount can be changed according to the amount of the base connecting units 211.

As shown in FIG. 2 to FIG. 6, in the first embodiment of the present invention, the electromagnetic sway module 50 is used for causing the translucent shell 20 to sway and thereby generate the lighting effect of a swaying candle flame. The electromagnetic sway module 50 is located in the case 10; the electromagnetic sway module 50 includes a metal bar 51, a metal coil 52 and a metal core 53. The metal bar 51 is an iron bar, the metal coil 52 is a copper coil, and the metal core 53 is an iron core. However, the type of the metal bar 51, the metal coil 52 and the metal core 53 is not limited to that design. When the metal bar 51 sways, the metal bar 51 causes the translucent shell 20 to sway via the connecting unit 40. The metal coil 52 is located under the metal bar 51, and connected to the circuit board 70. The metal core 53 is located in the metal coil 52. When the metal coil 52 is energized, the energizing metal coil 52 will let the metal core 53 become magnetic, and a magnetic field will be formed between the metal bar 51 and the metal core 53. The magnetic field keeps the metal bar 51 close to the metal core 53, allowing the metal bar 51 to sway above the metal core 53, and the swaying metal bar 51 causes the translucent shell 20 to sway via the connecting between the base connecting units 211 and the correspondingly connecting units 41. When the translucent shell 20 sways, the hole 112 of the translucent shell positioning unit 110 can limit the degree of swaying of the base connecting units 211 to represent the effect of a candle flame swaying slightly in an air current.

In the first embodiment of the present invention, the circuit board fastening unit 100 is located in the case 10, and the circuit board fastening unit 110 is fastened to the circuit board 70, allowing the position of the circuit board 70 and the metal coil 52 located on the circuit board 70 to be stable.

As shown in FIG. 2 to FIG. 7, in the first embodiment of the present invention, the circuit board 70 is located in the case 10. The circuit board 70 is used for controlling the light emitting unit 30, the electromagnetic sway module 50 and the power unit 80 of the electric flameless candle 1. The circuit board 70 provides a pulse current to the metal coil 52 irregularly. The power unit 80 is electrically connected to the light emitting unit 30, the electromagnetic sway module 50 and the circuit board 70; the power unit 80 is used for plugging to an external socket to obtain power and to provide power to the light emitting unit 30, the electromagnetic sway module 50 and the circuit board 70.

When the user wants to use the electric flameless candle 1 of the present invention, the user can plug the power unit 80 to the external power source or battery to obtain the power. When the power unit 80 receives the power, the circuit board 70 will activate. After the circuit board 70 receives the activation signal, the circuit board 70 provides the pulse current to the metal coil 52 irregularly. The energizing metal coil 52 lets the metal core 53 become magnetic, and a magnetic field will be formed between the metal bar 51 and the metal core 53. The magnetic field keeps the metal bar 51 close to the metal core 53, allowing the metal bar 51 to sway above the metal core 53. The swaying of the metal bar 51 causes the translucent shell 20 to sway along the sway directions M, M' via the connecting unit 40. When the translucent shell 20 sways, the circuit board 70 will also control the light emitting unit 30 to emit light; therefore, the swaying translucent shell 20 and the shining light emitting unit 30 represent the shape of a candle flame and the effect of a candle flame swaying slightly in an air current.

As shown in FIG. 8 and FIG. 9, in another shape of the electric flameless candle 1*a*, the translucent case 22*a* of the translucent shell 20*a* is shaped as a designed spherical shell, to represent a grimace shape. The electric flameless candle 1*a* can be applied to an external lampshade 200. The lampshade 200 has a translucent part 210 and a shading part 220. The translucent part 210 is made of translucent paper, cloth, film or glass, allowing the light to be revealed. The shading part 220 is made of opaque material, such as plastic, metal or paint sheet, for blocking the light. When the electric flameless candle 1*a* with the effect of a candle flame swaying slightly in an air current is put into the lampshade 200, the swaying translucent shell 20*a* will provide the effect of swaying and lighting designed shape, and represent a plurality of swaying and lighting areas 300 on the translucent part 210. Therefore, the lampshade 200 and the electric flameless candle 1*a* can provide an interesting and swaying lighting effect.

Via the design of the electric flameless candle of the present invention, the shape of a real candle flame and the effect of a candle flame swaying slightly in an air current can be represented, and the electric flameless candle can emit the light without a flame, posing no risk of fire or air pollution.

What is claimed is:

1. An electric flameless candle, comprising:

a case, comprising an opening;

a translucent shell positioning unit, located at the opening;

a translucent shell, located on the translucent shell positioning unit, wherein the translucent shell comprises a translucent shell base and a translucent case;

a light emitting unit, located on the translucent shell base, and located in the translucent case;

a connecting unit, connected to the translucent shell base;

an electromagnetic sway module, located in the case, wherein the electromagnetic sway module comprises:

a metal bar, connected to the connecting unit, wherein when the metal bar sways, the metal bar causes the translucent shell to sway;

a metal coil, located under the metal bar; and a metal core, located in the metal coil;

a circuit board, located in the case; and a power unit, electrically connected to the light emitting unit, the electromagnetic sway module and the circuit board;

wherein when the circuit board provides a pulse current to the metal coil, the energizing metal coil lets the metal core become magnetic, and a magnetic field is formed between the metal bar and the metal core, the magnetic field causes the metal bar to sway above the metal core, and a swaying of the metal bar causes the translucent shell to sway via the connecting unit.

2. The electric flameless candle as claimed in claim 1, wherein the circuit board provides the pulse current to the metal coil irregularly.

3. The electric flameless candle as claimed in claim 2, wherein the translucent shell base further comprises at least one base connecting unit, the connecting unit further comprises at least one correspondingly connecting unit; the at least one correspondingly connecting unit is connected to the at least one base connecting unit.

4. The electric flameless candle as claimed in claim 3, wherein the translucent shell positioning unit comprises a positioning groove and a hole, the positioning groove is connected to the hole, the translucent shell base is located on the positioning groove, and the at least one base connecting unit passes through the hole to connect to the at least one correspondingly connecting unit.

5. The electric flameless candle as claimed in claim 4, further comprising a circuit board fastening unit, the circuit board fastening unit is located in the case and fastened to the circuit board.

6. The electric flameless candle as claimed in claim 5, wherein the light emitting unit further comprises a tip, and the tip supports the translucent shell.

7. The electric flameless candle as claimed in claim 6, wherein an amount of the at least one base connecting unit is two, and an amount of the at least one correspondingly connecting unit is two.

8. The electric flameless candle as claimed in claim 7, wherein the light emitting unit is a light emitting diode.

9. The electric flameless candle as claimed in claim 8, wherein the metal bar is an iron bar.

10. The electric flameless candle as claimed in claim 9, wherein the metal core is an iron core.

11. The electric flameless candle as claimed in claim 10, wherein the metal coil is a copper coil.

* * * * *